US007746278B2

(12) United States Patent
Zweers

(10) Patent No.: US 7,746,278 B2
(45) Date of Patent: Jun. 29, 2010

(54) ANTENNA ARRANGEMENT

(75) Inventor: Jan-Willem Zweers, Nieuwleusen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 217 days.

(21) Appl. No.: 12/105,056

(22) Filed: Apr. 17, 2008

(65) Prior Publication Data

US 2009/0262030 A1 Oct. 22, 2009

(51) Int. Cl.
*H01Q 1/38* (2006.01)

(52) U.S. Cl. ..... 343/700 MS; 343/846

(58) Field of Classification Search ..... 343/700 MS, 343/702, 846, 848
See application file for complete search history.

(56) References Cited

U.S. PATENT DOCUMENTS 6,765,537 B1 * 7/2004 Apostolos ..... 343/741
2004/0113852 A1 6/2004 Lindell
2006/0145923 A1 7/2006 Autti
2007/0120748 A1 5/2007 Jenwatanavet et al.
2009/0102739 A1 * 4/2009 Chang et al. ..... 343/846

FOREIGN PATENT DOCUMENTS

EP 1 530 254 A1 5/2005

OTHER PUBLICATIONS

International Search Report issued in corresponding international application No. PCT/EP2008/063705, mailed Jan. 27, 2009, 3 pages.

* cited by examiner

*Primary Examiner*—Hoang V Nguyen
(74) *Attorney, Agent, or Firm*—Harrity & Harrity, LLP

(57) ABSTRACT

An antenna arrangement comprises a central part extending in a first plane, an antenna element comprised in an antenna part, which antenna part and antenna element extend from the central part in a second plane, a first counterpoise part, extending from the central part in a third plane, and a second counterpoise part extending from the central part in a fourth plane, the antenna arrangement is arranged in a functional position. The functional position implying that the folded first and second counterpoise parts together represents a counterpoise and the antenna element resonates together with the counterpoise, thus making the whole antenna arrangement serve as an antenna.

30 Claims, 3 Drawing Sheets

ANTENNA ARRANGEMENT

TECHNICAL FIELD

The present invention relates to wireless communication. In particular the present invention relates to an antenna arrangement and a wireless communication device comprising such an antenna arrangement.

BACKGROUND

It is often desirable to provide wireless communication rather than wired communication using cables between related pairs of devices separated by a short distance. Devices that communicate using cables often require the devices to be located in close proximity to each other as dictated in part by the length of the cables. In contrast, wireless communication decreases the amount of cabling between electronic devices and thus increases the ease of use and convenience for the user. Further the wireless communication devices, such as a portable electronic device, may add more security and may be more aesthetic. With wireless communication, the distance between the related devices is generally only limited by the limits of the wireless signal transmission and reception systems. Examples of related pairs of devices include a cordless headsets on the one hand and a telephone, computer, Personal Digital Assistant (PDA), television set, VCR, DVD player, video game player, stereo receiver, CD player, and MP3 player on the other hand. Other examples of related pairs of devices include a computer and its various external devices such as a monitor, printer, keyboard, mouse, telephone and speakers for example.

The portable electronic device comprises a small inbuilt antenna of high performance to perform as required. The antenna enables wireless communication between a radio unit in the portable electronic device and a radio unit in a corresponding unit. In general it is desirable to minimize the size of the portable electronic device so as to provide a device that is as discrete and as practical as possible. Thus the space for the antenna in the portable communication device is reduced almost day by day, resulting in a keen need of improvement for the antenna miniaturization.

The volume within the portable electronic device is governed by industrial design and may place restrictions on both the size of the antenna and the size of the ground plane. However the dimensions of the antenna residing within the portable electronic device are dictated by the wavelengths of the signals that the antenna is to receive and transmit as well as the form of the antenna. Examples of such signal wavelengths are e.g. Bluetooth 2400-2483.5 MHz which corresponds to a wavelength of about 12 cm in free space. Thus the antenna and the portable electronic device are designed with mutual consideration in order to accommodate the antenna within the portable electronic device.

Many types of antenna technologies may be chosen for the internal antenna of the portable electronic device. The selection depends upon the size and shape of the portable communication device volume into which the antenna must fit and the system performance requirements of the antenna.

A commonly known antenna is the T-antenna. The T-antenna comprises two wires, a first vertical or sloping wire and a second straight horizontal wire. The vertical wire is connected to the approximate central of the straight horizontal wire, thus forming the characteristic "T"-shape. The radiation pattern of a T-antenna is Omni-directional, just like a dipole antenna. The T-antenna is easily scalable relative to the used frequency(s). A disadvantage of a stretched-wire ½ wave dipole or T-antenna is the overall physical length of it. This makes it difficult to integrate it into a small product.

Meandered mono pole antennas are also commonly used in portable communication devices. The meandering pattern of the antenna enables a reduction of the overall physical length of the antenna element whilst retaining the same electrical length. Thus the meandered mono pole antenna is more scalable than the stretched wire dipole. The total length of a meandered monopole antenna is preferably chosen to be one quarter of the wavelength of the desired resonant frequency. However, other lengths could also be used for the resonator elements including three quarters, one and one quarter, ⅕'th etc. A disadvantage of a meandered monopole is still the relative large area it needs. The meandering of the antenna employs a relatively larger area compared to the area employed by a straight wire. Further the space between the meandering lines is unused. If this space is compromised to a minimum the bandwidth of the antenna is also compromised. This largely depends on the gab between the meandering pattern and the number of meanderings.

An Inverted F Antenna (IFA) is a planar antenna, having a low profile or a flat structure, that are commonly employed as internal antennas configured inside portable communication devices, such as handsets, operating in e.g. the 1900 MHz radio frequency band. A conventional Planar Inverted F Antenna (PIFA) includes a radiating element, a wire and a ground plane. The planar inverted F antenna is shaped like the letter F. The planar inverted F antenna, as well as, an inverted F antenna, both requires a relatively large ground plane to work correctly. This significantly limits the scalability of the F antenna types. Further the F antennas suffer from a narrow bandwidth characteristic which is a considerable limitation.

/Thus what is needed is an antenna for use in a portable communication device that meets the required communication performance without or with minimized performance degradation. Further it is highly desirable that the antenna is small, space efficient and light thus avoiding clumsy and unwieldy devices. In the case of the portable communication device being represented by a cordless headset it is further desirable that the antenna has a high efficiency when the headset is put in talk position, i.e. is arranged close to the body of the user.

The antenna should preferable also be configured to allow better placement of control switches, electronic components and/or buttons of the portable communication device. Ideally the antenna is also cost-effective to manufacture and easy to assemble.

SUMMARY

The object of the present invention is to provide an antenna arrangement that is small, space efficient and light whilst still meeting the required communication performance without or with minimized performance degradation.

According to a first aspect of the invention, the object is achieved by an antenna arrangement for wireless communication. The antenna arrangement comprises a central part extending in a first plane and an antenna element comprised in an antenna part which antenna part and antenna element extend from the central part in a second plane. The antenna arrangement further comprises a first counterpoise part extending from the central part in a third plane and a second counterpoise part extending from the central part in a fourth plane. The antenna arrangement is arranged in a functional position. The functional position is obtained when the antenna arrangement is folded such that:

The second plane of the antenna element s principally perpendicular to the first plane of the central part, the third plane of the first counterpoise part, is principally perpendicular to the first plane of the central part and principally perpendicular to the second plane of the antenna element, and the fourth plane of the second counterpoise part is principally perpendicular to the first plane of the central part and principally parallel with the second plane of the antenna element, and principally perpendicular to the third plane of the first counterpoise part. The functional position implies that the folded first and second counterpoise parts together represents a counterpoise and the antenna element resonates together with the counterpoise, thus making the whole antenna arrangement serve as an antenna.

In one embodiment, the antenna arrangement further comprises a third counterpoise part extending from the central part in a fifth plane. The functional position is obtained when the antenna arrangement is folded such that further the fifth plane of the third counterpoise part is principally parallel with the third plane of the first counterpoise part. The functional position implying that the folded first, second and third counterpoise parts together represents a counterpoise and the antenna element resonates together with the counterpoise, thus making the whole antenna arrangement serve as an antenna.

In one embodiment of the antenna arrangement, the antenna element is a T antenna or a monopole.

In one embodiment the antenna element is represented by a conductive material such as e.g. copper.

In one embodiment the functional position is represented by the shape of a vessel, a housing, a box, a container, a case holder, a receptacle, a reservoir.

In one embodiment the antenna arrangement is represented by a printed circuit board, a flexible printed circuit board, a conductive material.

In one embodiment the antenna arrangement comprises holes and/or through going cavities.

In one embodiment antenna arrangement is tuned to a wanted resonation frequency by adjusting the length and width of one or a plural of the arms of the antenna element.

In one embodiment the resonation frequency is 1-80 GHz, e.g. 2.5 GHz.

According to a second aspect of the invention the object is achieved by a wireless communication device comprising an antenna arrangement according to the first aspect of the invention In some embodiments the wireless communication device is represented by a head set, a cordless telephone, a cordless mouse, a cordless computer or a Personal Digital Assistant (PDA).

The present invention is very advantageous compared to prior art solutions, such as the inverted F antenna and the planar inverted F antenna which are designed to concentrate radio frequency currents only around the antenna area. The antenna arrangement according to the present solution instead uses the relative small 3D build-up ground plane (counterpoise) to radiate also. This gives the benefit of having an antenna arrangement 100 in functional position that is very space efficient and having good antenna efficiency near the human body but still is relative small in size.

BRIEF DESCRIPTION OF THE DRAWINGS

The present invention will now be described more in detail in relation to the enclosed drawings, in which.

DETAILED DESCRIPTION

The invention is defined as an antenna arrangement which may be put into practice in the embodiments described below. This invention may, however, be embodied in many different forms and should not be construed as limited to the embodiments set forth herein; rather, these embodiments are provided so that this disclosure will be thorough and complete, and will fully convey the scope of the invention to those skilled in the art. It should be understood that there is no intent to limit the present method or arrangement to any of the particular forms disclosed, but on the contrary, the present method and arrangement is to cover all modifications, equivalents, and alternatives failing within the scope of the invention as defined by the claims.

When using the word "comprise" or "comprising" it shalt be interpreted as non-limiting, in the meaning of "consist at least of".

Figure 1:
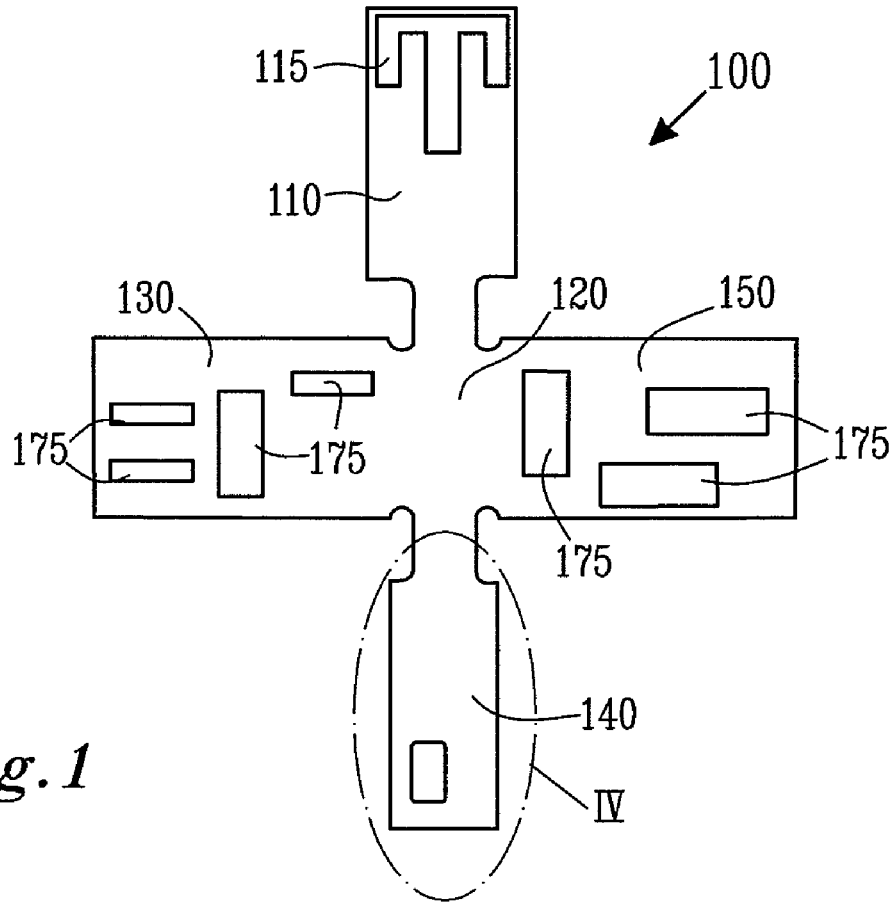
FIG. 1 is a block diagram illustrating embodiments of an antenna arrangement.

FIG. 1 depicts an antenna arrangement 100 according to some embodiments of the present solution before being arranged and folded into a functional position. The antenna arrangement 100 may be adapted to be used in a wireless device. Examples of such wireless devices are e.g. a cordless headset, a cordless mouse, a cordless printer, a cordless monitor for a computer and/or a phone and/or a Personal Digital Assistant (PDA), a cordless computer communicating with a corresponding computer dock.

The antenna arrangement 100 as depicted in FIG. 1 is arranged in a first position wherein the antenna arrangement 100 extends primarily in two dimensions. This is due to the fact that the antenna arrangement 100 also has a certain depth. According to some embodiments the antenna arrangement 100 in the first position may be flat and may be unfolded. The antenna arrangement 100 does not serve as the high efficient antenna in the first position, but could as well be a good functioning antenna. The antenna arrangement 100 may be made of e.g. a Printed Circuit Board (PCB), a flexible PCB or any relatively good conductive material.

The antenna arrangement 100 comprises a central part 120 extending in a first plane.

The antenna arrangement 100 further comprises an antenna element 115. The antenna element 115 is comprised in an antenna part 110. The antenna part 110 and antenna element 115 extend from the central part 120 in a second plane. The antenna arrangement 100 is adapted to convert signals received and/or signals to be output by the antenna element 115.

The antenna part 110 further comprises a first counterpoise part, 130 extending from the central part 120 in a third plane, and a second counterpoise part 140 extending from the central part 120 in a fourth plane.

The antenna arrangement 100, may further comprise a third counterpoise part (150) extending from the central part (120) in a fifth plane.

In this first position depicted in FIG. 1, before being arranged into a functional position, the antenna element 115, the central part 120, the first counterpoise part 130, the second counterpoise part 140 and the third counterpoise part 150 if available all extends in the same plane. When the first counterpoise part 130, the second counterpoise part 140 and the third counterpoise part 150 if available are folded into a functional position, together they represent a counterpoise. This is further described below.

Figure 3:
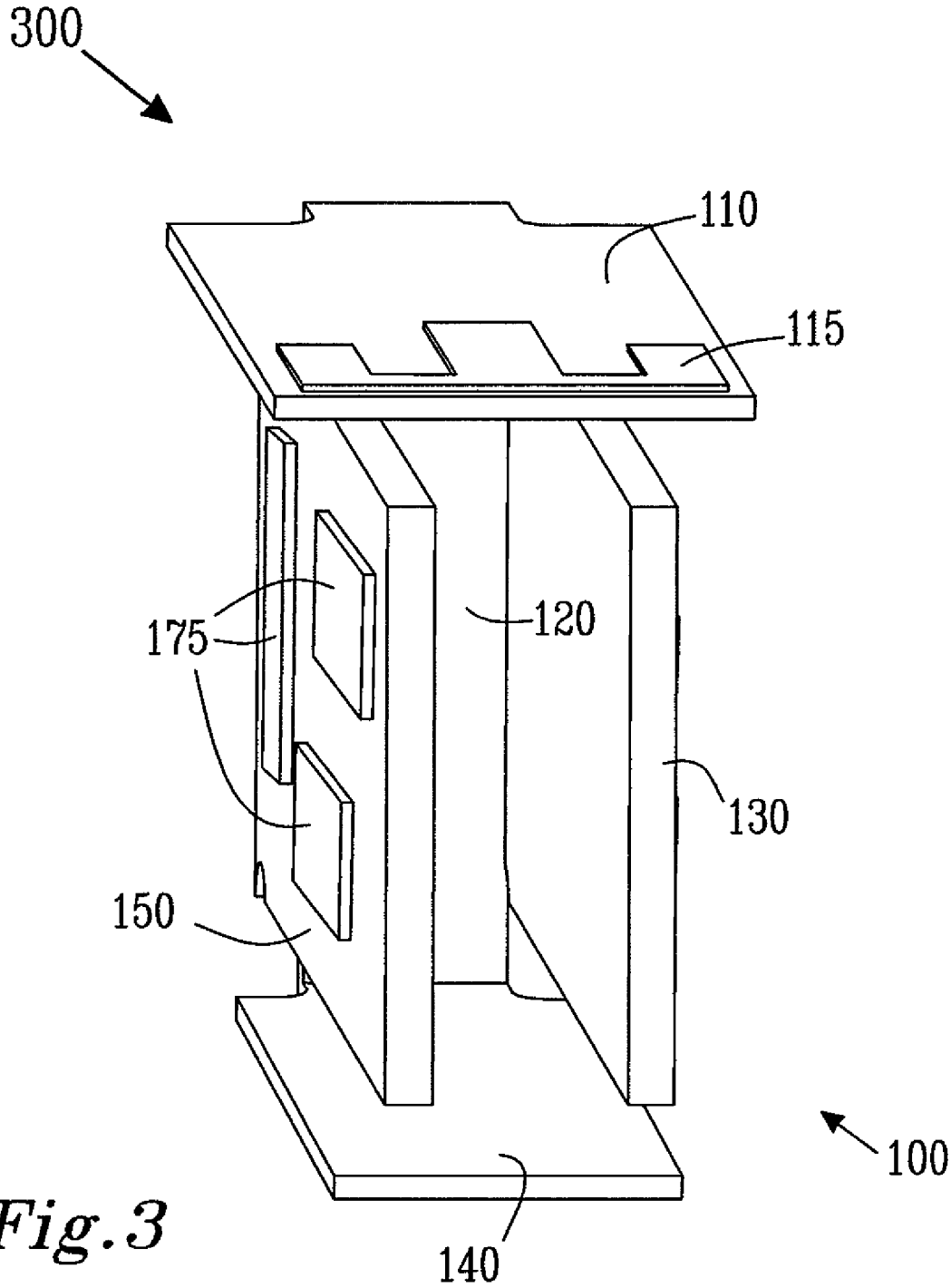
FIG. 3 is a block diagram illustrating embodiments of an antenna arrangement

In some embodiments, the antenna arrangement 100 is roughly shaped as a box like in FIG. 3 (to be described below) which is very advantageous for obtaining symmetrical near field behaviour when the antenna arrangement is arranged in a functional position, i.e. the functional position (FIG. 3).

The antenna arrangement 100 may further comprise common components to be able to work such as e.g. a signal converter, a signal contact and a small ground plane called a counterpoise (there is no real ground plane).

According to some embodiments the design of both the antenna element 115 and antenna arrangement 100 should be drawn with care and should at least contain one layer with a conducting covering of good conductivity. It is possible to have a less covering area concerning the planes of the central part 120, the first counterpoise part 130, the second counterpoise part 140 and the third counterpoise part 150 if available. But on average these should be a good enough counterpoise for the antenna—covering may be only of parts of the central part 120, the first counterpoise part 130, the second counterpoise part 140 and the third counterpoise part 150 if available. This is because the whole design of the antenna arrangement 100, such as e.g. a PCB, serves as an antenna, since the whole design of the antenna arrangement 100, when being arranged in a second position, i.e. a functional position, contributes to high performance of the antenna arrangement 100.

A counterpoise is just a small/bad ground plane which is divined relative to the longest relevant used wavelength of a device. A relative good ground plane covers at least and area lager then the square of the ½ wavelength.

If an antenna element as part 115 is mounted on a small ground plane, called a counterpoise, the counterpoise also starts to radiate and effectively becomes part of the whole antenna. If the counterpoise is too small then the antenna configuration doesn't work as efficient anymore.

The antenna element 115 may be made of a conductive material such as e.g. copper or a combination of conductive materials. The antenna element 115 may be adapted for wave lengths such as e.g. 1 GHz to 80 GHz. The antenna element 115 may be a small built-in antenna, thus the antenna element 115 is a part of the antenna arrangement 100 which may be arranged on or be integrated in the antenna part 100.

According to the embodiments wherein the antenna arrangement 100 is made of an Isolating material conducting wires may be needed to connect the antenna element 115 to an exciting point, e.g. placed at the folding between the central part 120 and the antenna part 110. Impedance matching may be commonly performed in order to maximize power transfer and minimize reflections of a signal back into the source.

According to some embodiments the antenna element 115 may be e.g. a T antenna, a monopole antenna or a conductive element of any shape which resonates together with the counterpoise to enlarge the antenna element 115 to enable the whole antenna arrangement 100 to serve as an antenna. The antenna arrangement 100 serves as an antenna with or without a matching network. A common matching network may comprise combinations of transformers, resistors, inductors and capacitors. The matching network is not depicted in any Figure.

Figure 2:
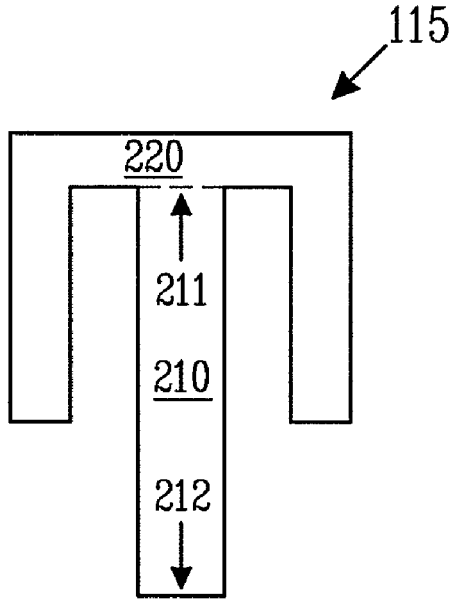
FIG. 2 is a block diagram illustrating embodiments of an antenna element.

FIG. 2 depicts the exemplary scenario wherein the antenna element 115 is a T antenna. The antenna element comprises a first arm 210 which is connected at a first end 211 to a central point of a second arm 220. The first arm 210 extends generally along a longitudinal length of the antenna element 115. The second arm 220 extends generally along a latitudinal length of the antenna element 115. The second arm 220 serves as a signal radiation and reception element and the first arm 210 also serves as a signal radiation and reception element. As depicted in FIG. 2 according to some embodiments the second arm 220 may be bent in one or both ends. The bending of the second arm 220 may be performed to be able to fit the antenna element within the antenna arrangement 100. Thus the shape of the antenna element 115 may be dependent of the shape of the antenna arrangement 100. Thus the antenna element 115 according to the present solution is very space efficient.

The shape of the antenna element 115 may be necessary when tuning the whole antenna arrangement 100 to a wanted resonation frequency. Examples of wanted resonation frequencies may be in the range of 1-80 GHz such as e.g. 2,5 GHz for Bluetooth communication. Tuning of resonation frequency may be performed by adjusting the length and width of the first arm 210 and/or the second arm 220 of the figure T of the antenna element 115. This means that the antenna arrangement 100 may be tuned to a wanted resonation frequency by adjusting the length and width of one or a plural of the arms 210, 220 of the antenna element 115.

The first arm 210 may comprise a second end 212 which is connected to an exciting port. The second end 212 of the first arm 210 of the antenna element 115 may be attached to the antenna arrangement 100 by using screws, rivets, pop rivets, by soldering, etched copper traces etc.

The antenna element 100 is adapted to be used when being arranged in a second position, from now on called the functional position 300 as seen in FIG. 3.

The functional position 300, which also may be called the functional position, comprises arranging, such as e.g. folding, bending, bowing, curving, some, or all, of the counterpoises in three dimensions. When using the word folding in this document it should be interpreted as any of folding, bending, bowing or curving.

According to the embodiments wherein the antenna arrangement 100 is comprised in a portable communication device, such as e.g. a headset the functional position 300 may be represented by an upright talk position located close to the body of the user, such as a left talk position and/or a right talk position.

The antenna arrangement 100 may be arranged in the functional position 300 in different ways. In the example of FIG. 3

To serve as an antenna, the antenna arrangement 100 is arranged in a functional position. The functional position is obtained when the antenna arrangement 100 is folded, i.e. folded, bent, bowed or curved or similar such that:

The second plane of the antenna element 115 is principally perpendicular to the first plane of the central part 120;

The third plane of the first counterpoise part 130, is principally perpendicular to the first plane of the central part 120 and principally perpendicular to the second plane of the antenna element 115; and The fourth plane of the second counterpoise part 140 is principally perpendicular to the first plane of the central part 120 and principally parallel with the second plane of the antenna element 115, and principally perpendicular to the third plane of the first counterpoise part 130.

If, the antenna arrangement 100 further comprises the third counterpoise part 150, the functional position being obtained when the antenna arrangement 100 is folded such that further the fifth plane of the third counterpoise part 150 is principally parallel with the third plane of the first counterpoise part 130.

The functional position implies that the folded first, second and if available third counterpoise parts 130,140, 150 together represent a counterpoise and the antenna element 115 resonates together with the counterpoise 130,140, 150, thus making the whole antenna arrangement 100 serve as an antenna.

The parts refer to being folded "principally perpendicular" and "principally parallel". This means that when folding the parts, i.e. the antenna element 115, the central part 120, the first counterpoise part 130, the second counterpoise part 140 and the third counterpoise part 150 if available, the antenna arrangement serves well as an antenna even if not being exactly perpendicular or parallel but more being principally perpendicular or parallel.

I.e. the functional position may be obtained by folding the antenna part 110 about 90 degrees toward the central part 120 and folding the second counterpoise part 140 about 90 degrees toward the central part 120. This results in that the antenna part 110 and the second counterpoise part 140 are arranged beside each other in parallel or close to in parallel. Further the first counterpoise part 130 is folded about 90 degrees, towards the central part 120 and the third counterpoise part 150 is folded about 90 degrees towards the central part 120. This results in that the first counterpoise part 130 and third counterpoise part 150 are arranged beside each other in parallel or close to in parallel. When the antenna is arranged in the functional position 300 some or all of the counterpoise parts are arranged in three dimensions forming e.g. a vessel, housing, box, container, case holder, receptacle reservoir.

The folded second position of the antenna arrangement 100 is highly advantageous since it enables a high efficiency in use of physical space, which results in a small design.

According to some embodiments some parts of, or all of, the antenna arrangement 100 may be used to put at least one component 175 on or nearby, as depicted in FIG. 1 and FIG. 3. The antenna arrangement 100 may preferable be configured to allow a space efficient placement of the components 175 such as e.g. control switches, electronic components and/or buttons of the portable communication device in which the antenna arrangement 100 may be comprised. This enables a good space efficiency of the antenna arrangement 100. This is very advantageous because it contributes to the minimization of the antenna arrangement 100 as well as of the portable communication device in which the antenna arrangement 100 may be used.

According to some embodiments the components 175 may be mainly made of a conductive material thus enabling the components to contribute to the operation of the antenna arrangement 100.

The antenna arrangement 100 is according to some embodiments almost 100% space efficient since some parts of or all of the antenna 100 may be used to put components 175 on or nearby.

The performance of the antenna arrangement 100 when being arranged in the second position 300 is very advantageous. Firstly since the antenna arrangement 100 provides a high bandwidth 33% relative to the centre frequency of the complete antenna arrangement 100. Secondly because the antenna efficiency, when the antenna arrangement 100 is arranged in the second position 300 such as e.g. placed in upright position, is much better compared to the antenna efficiency of a flat antenna such as e.g. a dipole or an Inverted F Antenna. All these points together make this a very powerful combination, especially when the antenna is operating very close to the body called talk position for a headset. In free space the efficiency of both antennas could be very well the same.

Thus the second position 300, i.e. the three dimensional build-up, of the antenna arrangement 100 has a positive effect on antenna efficiency, compared to prior art.

Figure 4:
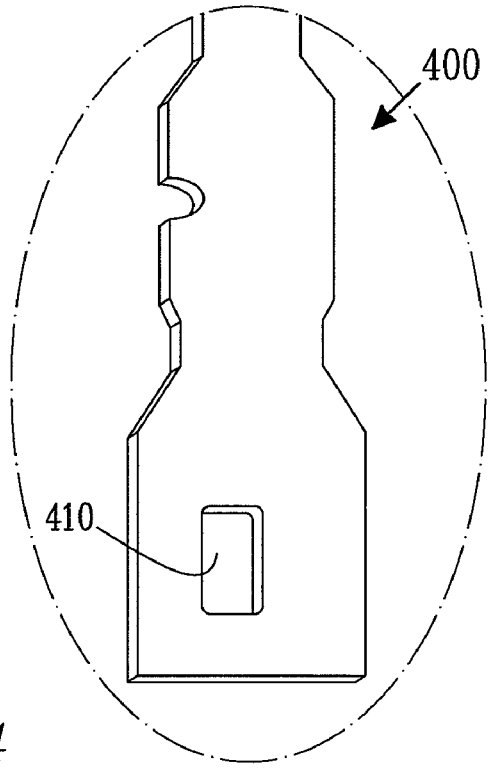
FIG. 4 is a block diagram illustrating embodiments of details of an antenna arrangement.

The design of the antenna arrangement 100 is flexible in such a way that the outline of the antenna arrangement 100 may be arranged in different ways. An example is seen in FIG. 4. FIG. 4 depicts a close-up of an exemplary embodiment of the second counterpoise part 140 where the outline 400 of the antenna arrangement 100 comprises straight parts, corners and round bends. Further the design of the antenna arrangement 100 is flexible in such a way which may render it possible for the antenna arrangement 100 to comprise a through going cavity 410. The through going cavity 410 may be used to put components 175 trough. Examples of such components 175 may be non conductive components, such as e.g. a plastic button, a mounting pin, etc. This is very advantageous since the design of where and how to arrange the components 175 attached to the antenna arrangement 100 may be simplified. Thus the flexible design of the antenna arrangement 100 may render it possible to minimize the size and the design of the antenna arrangement 100 since the components 175 arranged on the antenna arrangement 100 may be located in an optimized way concerning the physical space. This makes it possible to further minimize the wireless device wherein the antenna arrangement 100 may be comprised.

Figure 5:
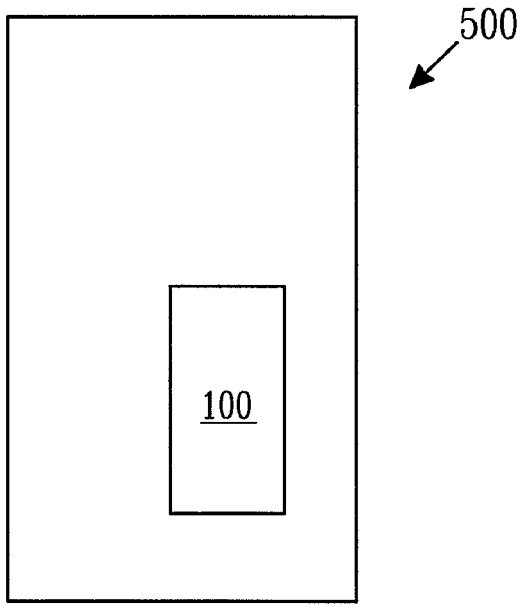
FIG. 5 is a block diagram illustrating an embodiment of a wireless communication device.

FIG. 5 depicts a wireless communication device 500 comprising the antenna arrangement 100. The wireless communication device 500 may be represented by a head set, a cordless telephone, a cordless mouse, a cordless computer, a Personal Digital Assistant (PDA) or similar.

The invention claimed is:

1. An antenna arrangement comprising:

a central portion extending in a first plane;

an antenna portion including an antenna element, wherein the antenna portion and the antenna element extend from the central portion in a second plane;

a first counterpoise portion extending from the central portion in a third plane; and a second counterpoise portion extending from the central portion in a fourth plane, wherein when the antenna arrangement is configured in a functional position:

the second plane of the antenna element is substantially perpendicular to the first plane of the central portion, the third plane of the first counterpoise portion is substantially perpendicular to the first plane of the central portion and substantially perpendicular to the second plane of the antenna element, and the fourth plane of the second counterpoise portion is substantially perpendicular to the first plane of the central portion and substantially parallel with the second plane of the antenna element, and substantially perpendicular to the third plane of the first counterpoise portion, wherein the first and second counterpoise portions form a counterpoise arrangement, the antenna element to operatively resonate together with the counterpoise arrangement; and a third counterpoise portion extending from the central portion in a fifth plane, the functional position being defined by the antenna arrangement being configured with the fifth plane of the third counterpoise portion being substantially parallel with the third plane of the first counterpoise portion, the first, second, and third counterpoise portions form the counterpoise arrangement.

2. The antenna arrangement of claim 1, wherein the antenna element is a T-antenna, a monopole, or a dipole.

3. The antenna arrangement of claim 1, wherein the antenna element is made from a conductive material.

4. The antenna arrangement of claim 3, wherein the conductive material comprises cooper.

5. The antenna arrangement of claim 1, wherein the functional position comprises at least one of a shape of a vessel, a housing, a box, a container, a case holder, a receptacle, or a reservoir.

6. The antenna arrangement of claim 1, wherein the antenna arrangement comprises at least one of a printed circuit board, a flexible printed circuit board, or a conductive material.

7. The antenna arrangement of claim 1, wherein the antenna arrangement is configured to resonate at a frequency of about 1 to about 80 GHz.

8. The antenna arrangement of claim 1, wherein the antenna arrangement is configured to resonate at a frequency of about 2.5 GHz.

9. An antenna arrangement comprising:

a central portion extending in a first plane;

an antenna portion including an antenna element, wherein the antenna portion and the antenna element extend from the central portion in a second plane;

a first counterpoise portion extending from the central portion in a third plane; and a second counterpoise portion extending from the central portion in a fourth plane, wherein, when the antenna arrangement is configured in a functional position:

the second plane of the antenna element is substantially perpendicular to the first plane of the central portion, the third plane of the first counterpoise portion is substantially perpendicular to the first plane of the central portion and substantially perpendicular to the second plane of the antenna element, and the fourth plane of the second counterpoise portion is substantially perpendicular to the first plane of the central portion and substantially parallel with the second plane of the antenna element, and substantially perpendicular to the third plane of the first counterpoise portion, wherein the first and second counterpoise portions form a counterpoise arrangement, the antenna element to operatively resonate together with the counterpoise arrangement, and wherein the antenna arrangement includes holes and/or throughgoing cavities.

10. The antenna arrangement of claim 9 wherein the antenna element is a T-antenna, a monopole, or a dipole.

11. The antenna arrangement of claim 9, wherein the antenna element is made from a conductive material.

12. The antenna arrangement of claim 11, wherein the conductive material comprises cooper.

13. The antenna arrangement of claim 9, wherein the functional position comprises at least one of a shape of a vessel, a housing, a box, a container, a case holder, a receptacle, or a reservoir.

14. The antenna arrangement of claim 9, wherein the antenna arrangement comprises at least one of a printed circuit board, a flexible printed circuit board, or a conductive material.

15. The antenna arrangement of claim 9, wherein the antenna arrangement is configured to resonate at a frequency of about 1 to about 80 GHz.

16. The antenna arrangement of claim 9, wherein the antenna arrangement is configured to resonate at a frequency of about 2.5 GHz.

17. An antenna arrangement comprising:

a central portion extending in a first plane;

an antenna portion including an antenna element, wherein the antenna portion and the antenna element extend from the central portion in a second plane, wherein the antenna arrangement is configured to tune to a desired resonation frequency by adjusting a length and a width of one or more arms of the antenna element;

a first counterpoise portion extending from the central portion in a third plane; and a second counterpoise portion extending from the central portion in a fourth plane, wherein, when the antenna arrangement is configured in a functional position:

the second plane of the antenna element is substantially perpendicular to the first plane of the central portion, the third plane of the first counterpoise portion is substantially perpendicular to the first plane of the central portion and substantially perpendicular to the second plane of the antenna element, and the fourth plane of the second counterpoise portion is substantially perpendicular to the first plane of the central portion and substantially parallel with the second plane of the antenna element, and substantially perpendicular to the third plane of the first counterpoise portion, wherein the first and second counterpoise portions form a counterpoise arrangement, the antenna element to operatively resonate together with the counterpoise arrangement.

18. The antenna arrangement of claim 17, wherein the antenna element is a T-antenna, a monopole, or a dipole.

19. The antenna arrangement of claim 17, wherein the antenna element is made from a conductive material.

20. The antenna arrangement of claim 19, wherein the conductive material comprises cooper.

21. The antenna arrangement of claim 17, wherein the functional position comprises at least one of a shape of a vessel, a housing, a box, a container, a case holder, a receptacle, or a reservoir.

22. The antenna arrangement of claim 17, wherein the antenna arrangement comprises at least one of a printed circuit board, a flexible printed circuit board, or a conductive material.

23. The antenna arrangement of claim 17, wherein the antenna arrangement is configured to resonate at a frequency of about 1 to about 80 GHz.

24. The antenna arrangement of claim 17, wherein the antenna arrangement is configured to resonate at a frequency of about 2.5 GHz.

25. A wireless communication device comprising:

an antenna arrangement including:

a central portion extending in a first plane;

an antenna portion including an antenna element, wherein the antenna portion and the antenna element extend from the central portion in a second plane;

a first counterpoise portion extending from the central portion in a third plane; and a second counterpoise portion extending from the central portion in a fourth plane, wherein, when the antenna arrangement is configured in a functional position:

the second plane of the antenna element is substantially perpendicular to the first plane of the central portion, the third plane of the first counterpoise portion is substantially perpendicular to the first plane of the central portion and substantially perpendicular to the second plane of the antenna element, and the fourth plane of the second counterpoise portion is substantially perpendicular to the first plane of the central portion and substantially parallel with the second plane of the antenna element, and substantially perpendicular to the third plane of the first counterpoise portion, wherein the first and second counterpoise portions form a counterpoise arrangement, the antenna element to operatively resonate together with the counterpoise arrangement; and a third counterpoise portion extending from the central portion in a fifth plane, the functional position being defined by the antenna arrangement being configured with the fifth plane of the third counterpoise portion being substantially parallel with the third plane of the first counterpoise portion, the first, second, and third counterpoise portions form the counterpoise arrangement.

26. The wireless communication device of claim 25, wherein the wireless communication device comprises a headset, a cordless telephone, a cordless mouse, a cordless computer, or a personal digital assistant.

27. A wireless communication device comprising:

an antenna arrangement including:

a central portion extending in a first plane;

an antenna portion including an antenna element, wherein the antenna portion and the antenna element extend from the central portion in a second plane;

a first counterpoise portion extending from the central portion in a third plane; and a second counterpoise portion extending from the central portion in a fourth plane, wherein, when the antenna arrangement is configured in a functional position:

the second plane of the antenna element is substantially perpendicular to the first plane of the central portion, the third plane of the first counterpoise portion is substantially perpendicular to the first plane of the central portion and substantially perpendicular to the second plane of the antenna element, and the fourth plane of the second counterpoise portion is substantially perpendicular to the first plane of the central portion and substantially parallel with the second plane of the antenna element, and substantially perpendicular to the third plane of the first counterpoise portion, wherein the first and second counterpoise portions form a counterpoise arrangement, the antenna element to operatively resonate together with the counterpoise arrangement, and wherein the antenna arrangement includes holes and/or through-going cavities.

28. The wireless communication device of claim 27, wherein the wireless communication device comprises a headset, a cordless telephone, a cordless mouse, a cordless computer, or a personal digital assistant.

29. A wireless communication device comprising:

an antenna arrangement including:

a central portion extending in a first plane;

an antenna portion including an antenna element, wherein the antenna portion and the antenna element extend from the central portion in a second plane, wherein the antenna arrangement is configured to tune to a desired resonation frequency by adjusting a length and a width of one or more arms of the antenna element;

a first counterpoise portion extending from the central portion in a third plane; and a second counterpoise portion extending from the central portion in a fourth plane, wherein, when the antenna arrangement is configured in a functional position:

the second plane of the antenna element is substantially perpendicular to the first plane of the central portion, the third plane of the first counterpoise portion is substantially perpendicular to the first plane of the central portion and substantially perpendicular to the second plane of the antenna element, and the fourth plane of the second counterpoise portion is substantially perpendicular to the first plane of the central portion and substantially parallel with the second plane of the antenna element, and substantially perpendicular to the third plane of the first counterpoise portion, wherein the first and second counterpoise portions form a counterpoise arrangement, the antenna element to operatively resonate together with the counterpoise arrangement.

30. The wireless communication device of claim 29, wherein the wireless communication device comprises a headset, a cordless telephone, a cordless mouse, a cordless computer, or a personal digital assistant.

* * * * *